US005978641A

United States Patent [19]

Wayman et al.

[11] Patent Number: 5,978,641

[45] Date of Patent: Nov. 2, 1999

[54] COAXIAL INTEGRAL HEATING FUSING BELT

[75] Inventors: William H. Wayman, Ontario; Rasin Moser, Fairport, both of N.Y.

[73] Assignee: Xerox Corporation, Stamford, Conn.

[21] Appl. No.: 09/174,043

[22] Filed: Oct. 16, 1998

[51] Int. Cl.[6] ..... G03G 15/20

[52] U.S. Cl. ..... 399/329; 219/216

[58] Field of Search ..... 399/307, 329, 399/335, 338; 219/216, 388, 464, 468, 528, 553; 198/952

[56] References Cited

U.S. PATENT DOCUMENTS

| | | | |
|---|---|---|---|
| 4,582,416 | 4/1986 | Karz et al. | 399/329 |
| 4,724,305 | 2/1988 | Iimura et al. | 219/469 |
| 4,912,514 | 3/1990 | Mizutani | 399/308 |
| 5,115,279 | 5/1992 | Nishikawa et al. | 399/331 |
| 5,436,712 | 7/1995 | Wayman et al. | 399/328 |
| 5,450,182 | 9/1995 | Wayman et al. | 355/285 |
| 5,530,534 | 6/1996 | Dalal | 399/307 |
| 5,708,950 | 1/1998 | Badesha et al. | 399/333 |
| 5,869,808 | 2/1999 | Hyllberg | 219/216 |
| 5,881,349 | 3/1999 | Nanataki et al. | 399/328 |

FOREIGN PATENT DOCUMENTS 6-176851 6/1994 Japan .

OTHER PUBLICATIONS

P. 4 of Report No. X9300431, "Modeling of Instant–On Integral Heating Annular Resistor Roll Fuser", by S. Hwang, Jun. 1993. P. 4 describes Canon's PC–1 model.

*Primary Examiner*—Robert Beatty
*Attorney, Agent, or Firm*—John M Kelly

[57] ABSTRACT

A rapid warm-up fuser belt (and fusers and marking machines that use such a fuser belt) comprised of a conductive substrate having a resistive heating layer on one side and a release layer on the other side. The fuser belt further enables an electrical contact to the conductive substrate. Electrical current passing through the conductive substrate and through the resistive heating layer, causes the resistive heating layer to heat. The fuser belt can either provide for a direct electrical connection to the resistive heating layer, or it can include a semiconductive layer on the resistive heating layer that improves the electrical connection to the resistive heating layer.

17 Claims, 3 Drawing Sheets

COAXIAL INTEGRAL HEATING FUSING BELT

This invention relates to electrophotographic printing machine fusers. More particularly, it relates to rapid warm up fuser belts.

BACKGROUND OF THE INVENTION

Electrophotographic marking is a well-known, commonly used method of copying or printing documents. Electrophotographic marking is performed by exposing a charged photoreceptor with a light image representation of a desired document. In response to that light image the photoreceptor discharges, creating an electrostatic latent image of the desired document on the photoreceptor's surface. Toner particles are then deposited onto that latent image, forming a toner image. That toner image is then transferred from the photoreceptor onto a substrate, such as a sheet of paper. The transferred toner image is then fused to the substrate, usually using heat and/or pressure, thereby creating a permanent image. The surface of the photoreceptor is then cleaned of residual developing material and recharged in preparation for the production of another image.

In order to fuse toner onto a substrate it is beneficial to heat the toner to a point where the toner coalesces and become tacky. To an extent this causes the toner to flow into the fibers or pores of the substrate. Adding pressure increases the toner flow. Then, as the toner cools it becomes permanently attached to the substrate.

Because both heat and pressure are beneficial when fusing, most fusers include a heated element and a pressure-inducing element that form a nip. When a toner bearing substrate passes through that nip, heat from the heated element and pressure within the nip fusers the toner with the substrate.

One type of fuser uses a heated belt and a nip-forming backup (or pressure) roller. Reference, U.S. Pat. No. 5,450,182 to Wayman et al. on Sep. 12, 1995 and entitled "Apparatus and Method for Fusing Toner Images on Transparent Substrate," and U.S. Pat. No. 5,708,950 to Badesha et al. on Jan. 13, 1998 and entitled "Transfuser." Fuser belts have been heated by incorporating a resistive heating element on one side of an electrical insulating main substrate and by passing an electrical current lengthwise through the resistive heating layer. Furthermore, at least when using the fusing belt for transfusing (wherein the toner layer is transferred onto the belt and then fused from the belt onto a substrate), fusing belts have also included a release layer to assist toner transfer.

While resistively heated fusing belts have successfully been used for fusing, they generally suffer from limited life. This is at least partially due to the thermal effects of expansion of the belt. Since the main substrate is typically a thermally and electrically insulating material such as polyimide, sufficient mechanical strength and sufficient thermal flow were difficult to simultaneously achieve. Much stronger metallic fusing belts could not be used because they would short out the resistive heating layer. Despite their limited life, resistively heated fusing belts are desirable because they have the distinct advantage of rapid heating. This allows for energy conservation by enabling the fuser to be heated only when needed.

Therefore, a resistively heated fuser belt having a robust metallic substrate would be beneficial.

SUMMARY OF THE INVENTION

This invention provides for metallic-substrate, resistively heated fuser belts, for fusers that include metallic-substrate, resistively heated fuser belts, and for marking machines that include fusers that have metallic-substratc, resistively heated fuser belts.

A fuser belt in accordance with the principles of the present invention is comprised of a metallic substrate having a resistive heating layer on one side and a release layer on the other side. The fuser belt provides for an electrical contact to the resistive heating layer. Another electrical contact, beneficially a conductive roller, also contacts the resistive heating layer. The electrical contacts enable electrical current to pass through the resistive heating layer, causing it to heat. The fuser belt can either allow a direct electrical connection resistive heating layer, or it can include a semiconductive layer. If overlaid with a semiconductive layer, that layer then provides an electrical connection between the resistive heating layer and an electrical connection to the power supply.

A fuser in accordance with the principles of the present invention is comprised of a fuser belt having a metallic substrate, a contact roller, and an electrical current source. The fuser belt includes a resistive heating layer on one side of the metallic substrate, a release layer on the other side, and provisions for electrical contact with the metallic substrate. The resistive heating layer is operatively connected to the contact roller. The electrical current source operatively connects to the contact roller and the metallic substrate. Current passes through the metallic substrate, through the resistive heating layer (which causes the resistive heating layer to heat the fusing belt), and into the contact roller. A semiconductive layer may be disposed between the resistive heating layer and the contract roller. Beneficially, the contact roller is comprised of a thermally insulating layer that is overlaid with an electrically conductive layer that provides for current flow.

A marking machine in accordance with the principles of the present invention is comprised of a photoconductive surface a charging station for charging the photoconductive surface, an exposure station for producing an electrostatic latent images on the photoconductive surface, a developing station for depositing toner on the electrostatic latent image to form a toner image, a transfer station for transferring the toner image from the photoconductive surface, and a fusing station for fusing the toner image to a substrate. The fusing station is comprised of a fuser belt having a metallic substrate, a contact roller, and an electrical power source. The fuser belt includes a resistive heating layer on one side of the metallic substrate, a release layer on the other side, and a provision for an electrical contact with the metallic substrate. The resistive heating layer is operatively connected to the contact roller. The electrical current source passes current through the metallic substrate, through the resistive heating layer (which causes the resistive heating layer to heat the fusing belt), and into the contact roller. A semiconductive layer may be disposed between the resistive heating layer and the contract roller. Beneficially, the contact roller is comprised of a thermally insulating layer that is overlaid with a metallic layer that provides for current flow.

BRIEF DESCRIPTION OF THE DRAWINGS

Other aspects of the present invention will become apparent as the following description proceeds and upon reference to the drawings, in which.

DETAILED DESCRIPTION OF AN EMBODIMENT OF THE INVENTION

The preferred embodiment of the present invention includes a plurality of individual subsystems which are known in the prior art, but which are organized and used in a novel, non-obvious, and useful way. While the illustrated embodiment is a black and white electrophotographic printer, the present invention is not limited to such embodiments. For example, and without limitation, the principles of the present invention can be used in other systems, such as color printing machines, facsimile machines, and copiers. Therefore, it is to be understood that the present invention is intended to cover all alternatives, modifications and equivalents as may be included within the scope of the appended claims.

Figure 1:
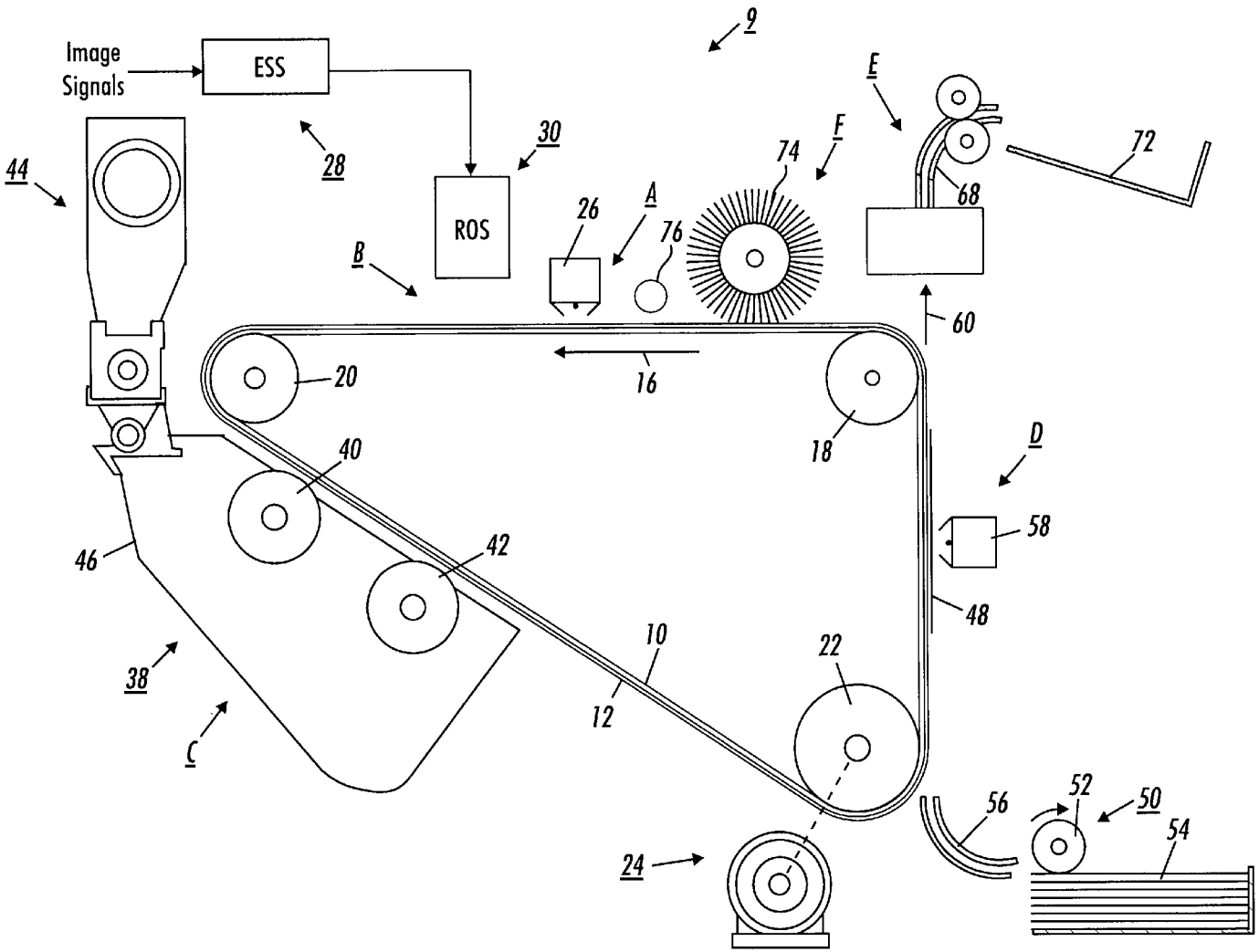
FIG. 1 is a schematic illustration of an electrophotographic marking machine that incorporates the principles of the present invention.

FIG. 1 schematically illustrates an electrophotographic printing machine 9 that employs a belt 10 having a photoconductive surface 12. The belt 10 is entrained about a stripping roller 18, a tensioning roller 20 and a drive roller 22. The drive roller 22 is rotated in a direction 16 by a motor 24.

As the photoconductive surface travels each part of it passes through each of the subsequently described processing stations. For convenience, a single section of the surface, referred to as the image area, is identified. The image area is that part of the photoreceptor that is to receive a toner layer which, after being transferred and fused to a substrate, produces the final image. While the photoreceptor may have more than one image areas, since each image area is processed in the same way a description of the processing of one image area suffices to fully explain the operation of the printing machine.

Initially, the image area passes through a charging station A. There, a corona generating device 26 charges the image area to a relatively high, substantially uniform potential. After being charged the image area advances to an exposure station B.

At exposure station, B, an electronic subsystem (ESS) 28, receives image signals that digitally represent the desired image. The electronic subsystem processes the received image signals and converts them to a suitable form for a raster output scanner (ROS) 30. Preferably, the electronic subsystem 28 is a self-contained, dedicated minicomputer. The image signals received by the electronic subsystem may originate from a computer, thereby enabling the electrophotographic printing machine to serve as a remotely located printer for one or more computers. Alternatively, the printer may serve as a dedicated printer for a high-speed computer.

The raster output scanner 30 includes a laser diode (which is not shown) that is intensity modulated by the signals from the electronic subsystem and a rotating multifaceted polygon (which is also not shown). The intensity modulated laser beam is applied to facets of the polygon. Light reflected by the facets is directed onto the image area. As the polygon rotates, and as the image area advances in the direction 16, the laser beam raster scans the image area, resulting in an electrostatic latent image that corresponds to the desired final image.

After the electrostatic latent image has been recorded, the image area advances to a development station C. The development station C includes a magnetic brush developer 38. The magnetic brush developer 38 includes two magnetic brush developer rollers 40 and 42 that advance toner onto the latent image. The developer rollers form magnetic brushes that are comprised of carrier granules and toner particles that extending outwardly from the carrier granules. The latent image attracts toner particles from the carrier granules so as to form a toner image on the latent image. As successive electrostatic latent images are developed, toner particles are depleted from the developer material. Then, a toner particle dispenser 44 dispenses toner particles into the developer housing 46.

Still referring to FIG. 1, after the electrostatic latent image is developed, the resulting toner image advances to a transfer station D. In addition to the toner image on the belt 10, a substrate 48 is advanced to the transfer station D by a sheet feeder 50. The sheet feeder 50 includes a feed roll 52. The feed roll advances the uppermost substrate from a stack 54 of substrates into a chute 56. That chute directs the advancing substrate in a timed sequence such that the advancing substrate contacts the toner powder image within the transfer station D. Transfer station D also includes a corona generating device 58 that sprays ions onto the back side of the substrate 48. This causes the toner image to transfer from the belt 10 to the substrate 48. After transfer, the substrate 48 advances in the direction 60 into a fusing station E.

After the substrate 48 separates from the belt 10, any residual developer particles or other debris adhering to the photoconductive surface 12 are removed at cleaning station F. There, a rotating fibrous brush 74 in contact with photoconductive surface 12 cleans that surface. After cleaning, a discharge lamp 76 floods the photoconductive surface 12 with light to dissipate any residual electrostatic charges.

The fusing station E permanently affixes the transferred powder image to the substrate 48. As the present invention is most directly related to the fusing station, the fusing station is discussed in more detail subsequently. After fusing, the substrate 48 advances through a chute 68 into a catch tray 72 for removal by a machine operator.

The machine stations described above are beneficially controlled by a programmable microprocessor (which is not shown). Various sensors, switches, drives, power supplies and other elements (which are also not specifically shown) connect to the machine stations, their elements, or to the controller as required to perform the functions described above. It is believed that the foregoing description is sufficient for the purposes of the present application to illustrate a machine in which a fusing station in accord with the principles of the present invention can be effectively utilized.

Figure 2:
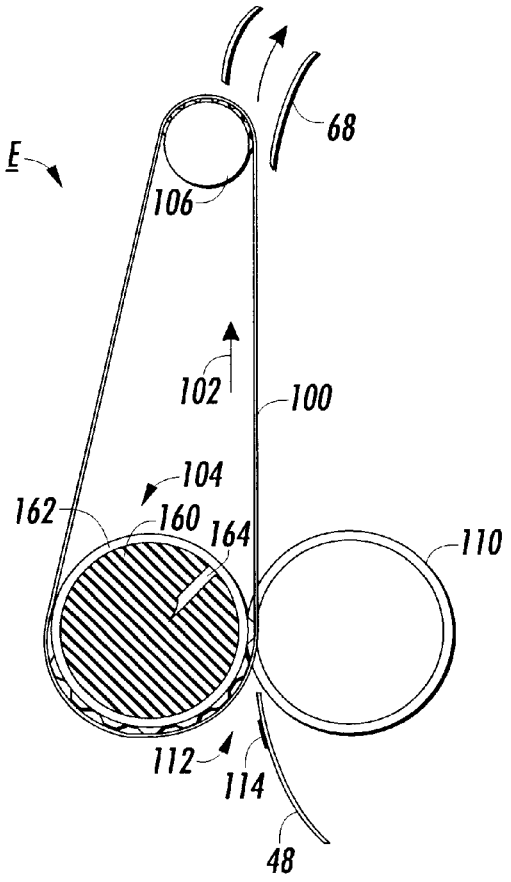
FIG. 2 schematically illustrates a fuser station used in the electrophotographic marking machine illustrated in FIG. 1.

Attention is now directed to FIG. 2, wherein the fusing station E is shown in more detail. That fusing station includes a fusing belt 100 that rotates in the direction 102. The fusing belt is entrained about a contact roller 104 and a stripper roller 106. A motor, that for clarity is not shown, rotates one of the rollers. The fusing station E further includes a pressure roller 110 that forms a fusing nip 112 with the fusing belt 100. In operation, the fusing belt generates heat (in a manner to be discussed subsequently) while approaching the nip 112. When a toner bearing substrate 48 passes through the nip the heat generated by the fusing belt 100 and the pressure caused by the pressure roller 110 fuse the toner to the substrate. That substrate then passes through the chute 68.

Figure 3:
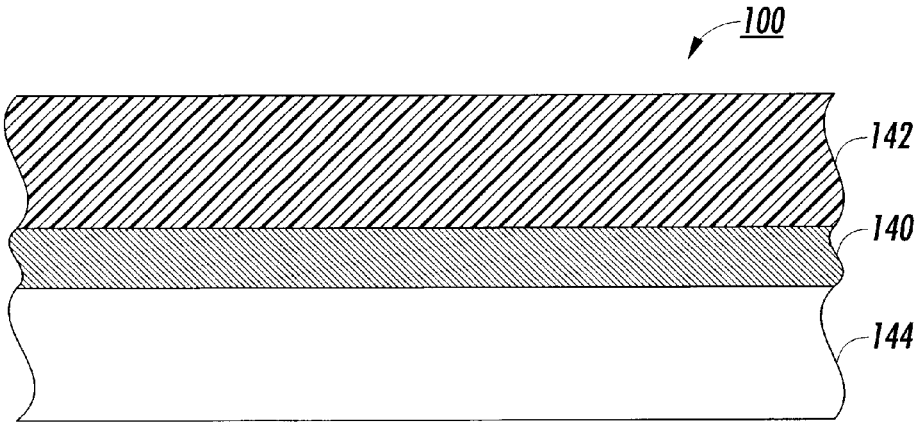
FIG. 3 shows a cross-sectional view of a fuser belt used in the fuser assembly illustrated in FIG. 2.

One embodiment of a fusing belt 100 is illustrated in FIG. 3. That belt is comprised of a metallic substrate 140. On one side of the metallic substrate is a release layer 142 and on the other side is a resistive heating layer 144. The metallic substrate might be made of steel, aluminum, stainless steel, nickel, or some other conductive material. The release layer is beneficially comprised of a low surface energy elastomer, such as (but not limited to) tetrafluoroethylene. A release agent, such as silicone oil, might be applied to the release layer to improve separation of toner from the fuser belt. The resistive heating layer is beneficially a high temperature, thick film resistive coating having a resistivity of around 30–60 MΩ/square. The coating resistance is chosen so that the total resistance from contact roller 104 to belt substrate 140 is between about 10 and 30 ohms so as to dissipate sufficient power when connected to wall current. Suitable resistive coatings are comprised electrically conductive particles embedded in a resistive layer. For example, suitable resistive coatings might be comprised of carbon black loaded fluoropolymers. An alternative resistive coating can be made of a mixture of antimony-doped tin oxide and Viton.

Referring now to both FIGS. 2 and 3, in operation, the fusing belt 100 is arranged such that the release layer is adjacent the pressure roller 110 while the resistive heating layer 144 contacts the contact roller 104. Electrical current is passed, in a manner that is described below, between the contact roller and the metallic substrate. This requires that the contact roller remain in good electrical contact with the resistive heating layer, and that requires that the resistive heating layer conform to the contact roller. Unfortunately, resistive heating layers may not adequately conform to the contact roller. This results in uneven current flow through the resistive heating layer, and thus uneven heating.

Figure 4:
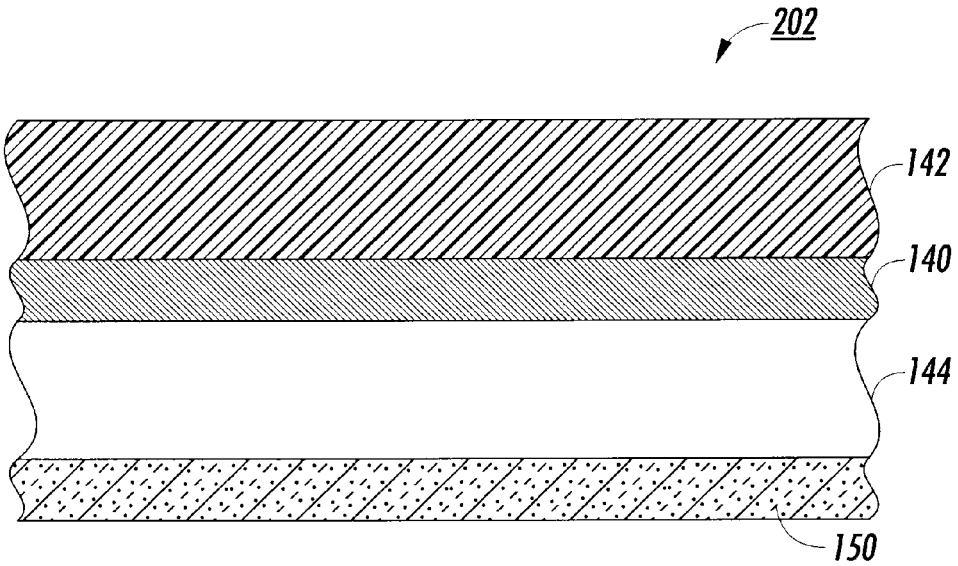
FIG. 4 shows a cross-sectional view of an alternative fuser belt used in the fuser assembly illustrated in FIG. 2.

A solution to the uneven heating problem is illustrated in FIG. 4. FIG. 4 shows a fusing belt 202 that is the same as the fuser belt 100, except that a semiconductive layer 150 covers the resistive heating layer 144. The semiconductive layer 150 has a resistivity in the range of about 10–20 KΩ/square. This semiconductive layer "spreads" current from the contact roller over the resistive heating layer 144. This results in a more uniform current flow through the resistive heating layer, and consequently a more uniform heating.

Since heat from the resistive heating layer 144 is used for fusing, it is important that as much heat as possible get to the fusing nip 112. Turning now to FIG. 2, one element that might divert heat from the fusing nip 112 is the contact roller 104. To reduce heat flow into the contact roller it is beneficial to make the contact roller from a heat insulating material. However, the contact roller must also supply electrical current to the resistive heating layer. That requires an electrical conductor, and electrical conductors are typically heat conducting. Therefore, the contact roller 104 beneficially has a core 160 made from a heat insulating material, such as a ceramic. That core is then surrounded by a thin metal layer 162 having an electrical contact 164. For example, that contact might be a carbon brush.

Figure 5:
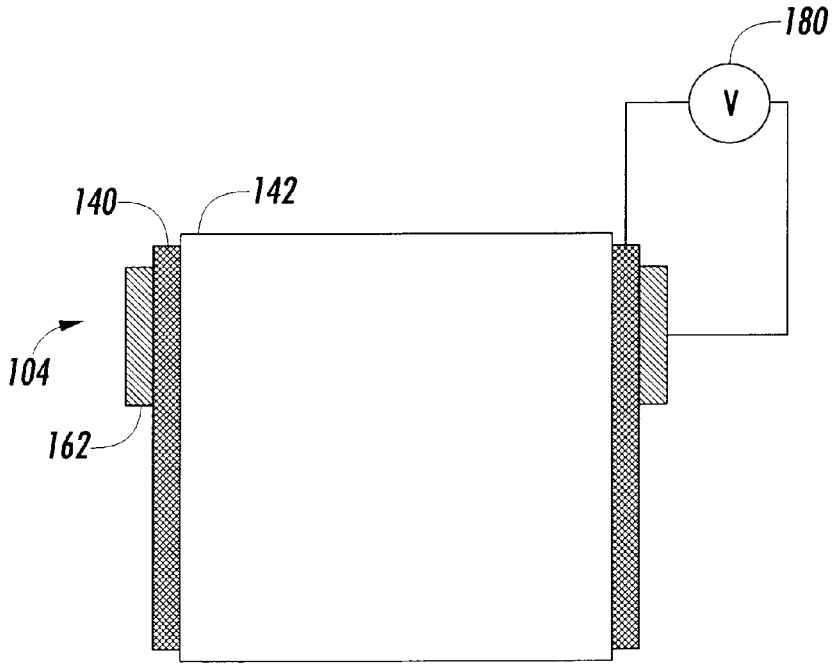
FIG. 5 illustrates the manner of heating; the fusing belt.

With an understanding of the contact roller 104 and the fusing belt 112, the method of generating heat in the fusing station E is readily understood. Turning now to FIG. 5, in addition to the elements shown in FIG. 2, the fusing station E also includes a power supply 180. That power supply electrically connects between the metal layer 162 of the contact roller and the metallic substrate 140 of the fusing belt. Electrical current then flows through the resistive heating layer 144 (not shown in FIG. 5), generating heat. That heat then flows through the metallic substrate 140 to the release layer 142. Significantly, the resistive heating layer is only heated between the contact roller and the fusing belt substrate.

It is to be understood that while the figures and the foregoing description illustrate the present invention, they are exemplary only. Others who are skilled in the applicable arts will recognize numerous modifications and adaptations of the illustrated embodiment that will remain within the principles of the present invention. Therefore, the present invention is to be limited only by the appended claims.

We claim:

1. A fusing belt comprised of:

a metallic substrate have a first surface and a second surface:

a resistive layer disposed on said first surface;

a release layer comprised disposed on said second surface; and a semiconductive layer disposed on said resistive layer.

2. The fusing belt according to claim 1, wherein said resistive layer is comprised of a high temperature material.

3. The fusing belt according to claim 1, wherein said resistive layer includes electrically conductive particles.

4. The fusing belt according to claim 1, wherein said conductive substrate includes nickel.

5. The fusing belt according to claim 1, wherein said conductive substrate includes stainless steel.

6. The fusing belt according to claim 1, wherein said conductive substrate includes aluminum.

7. A fuser comprised of:

a fusing belt member comprised of a metallic substrate have a first surface and a second surface, a resistive layer disposed on said first surface, and a release layer disposed on said second surface;

a contact roller in electrical contact with said fusing belt;

an electrical connection in electrical contact with said metallic substrate;

an electrical source, operatively connected to said contact roller and to said electrical connection, said electrical source for sending electrical current through said resistive layer such that said resistive layer heats said fusing belt; and a semiconductive layer over said resistive layer.

8. A fuser according to claim 7, further including a pressure roller adjacent said release layer, said pressure roller for forming a fusing nip with said fusing belt.

9. The fuser according to claim 7, wherein said resistive layer is comprised of a fluoropolymer.

10. The fuser according to claim 7, wherein said resistive layer includes electrically conductive particles.

11. The fuser according to claim 7, wherein said contact roller is comprised of a thermally insulating material.

12. The fuser according to claim 11, wherein said thermally insulating material includes a ceramic.

13. The fuser according to claim 11, wherein said contact roller includes a conductive surface for providing electrical contact with said fuser belt.

14. A printing machine, comprising:

a photoreceptor having a photoconductive surface;

a charging station for charging said photoconductive surface to a predetermined potential;

an exposure station for exposing said photoconductive surface to produce an electrostatic latent image on said photoconductive surface;

a developing station for depositing developing material on said electrostatic latent image so as to produce a toner image on said photoconductive surface;

a transfer station for transferring said toner image on said photoconductive surface to a substrate; and a fusing station for fusing said toner image on said photoconductive surface to said substrate, said fusing station including:

a fusing belt member comprised of a metallic substrate have a first surface and a second surface, a resistive layer disposed on said first surface, and a release layer disposed on said second surface;

a contact roller in electrical contact with said fusing belt;

an electrical connection in electrical contact with said metallic substrate;

an electrical source, operatively connected to said contact roller and to said electrical connection, said electrical source for sending electrical current through said resistive layer such that said resistive layer heats said fusing belt; and a semiconductive layer over said resistive layer and disposed between said resistive layer and said contact roller.

15. The fuser according to claim 14, wherein said contact roller is comprised of a thermally insulating material.

16. The fuser according to claim 15, wherein said thermally insulating material includes a ceramic.

17. The fuser according to claim 15, wherein said contact roller includes a conductive surface for providing electrical contact with said fuser belt.

* * * * *